US006454597B1

(12) United States Patent
Marsh et al.

(10) Patent No.: US 6,454,597 B1
(45) **Date of Patent: *Sep. 24, 2002**

(54) DIRECT TO CLOSET WIRING SYSTEM

(75) Inventors: John K. Marsh, Wolcottville; Jeff Schultz, Fort Wayne, both of IN (US)

(73) Assignee: Dekko Engineering, Inc., Kendallvile, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 148 days.

(21) Appl. No.: 09/198,033

(22) Filed: Nov. 23, 1998

Related U.S. Application Data

(63) Continuation-in-part of application No. 09/028,135, filed on Feb. 23, 1998.

(51) Int. Cl.[7] ..... H01R 11/00
(52) U.S. Cl. ..... 439/502; 439/638
(58) Field of Search ..... 439/502, 638, 439/639, 651, 65, 76, 654, 660, 668, 676, 709, 712

(56) References Cited

U.S. PATENT DOCUMENTS

| | | | | |
|---|---|---|---|---|
| 4,829,564 A | | 5/1989 | Jarvis | 379/327 |
| 5,149,277 A | | 9/1992 | LeMaster | 439/207 |
| 5,160,276 A | * | 11/1992 | Marsh et al. | 439/502 |
| 5,272,277 A | * | 12/1993 | Humbles et al. | 174/48 |
| 5,586,914 A | | 12/1996 | Foster, Jr. et al. | 439/676 |
| 5,593,317 A | * | 1/1997 | Humbles | 439/502 |
| 5,596,169 A | | 1/1997 | Baker et al. | 174/33 |
| 5,618,185 A | | 4/1997 | Aekins | 439/76.1 |
| 5,651,701 A | | 7/1997 | Chen | 439/607 |
| 5,679,027 A | | 10/1997 | Smith | 439/676 |
| 5,719,933 A | | 2/1998 | Welch | 379/397 |

* cited by examiner

*Primary Examiner*—Brian Sircus
*Assistant Examiner*—Son V. Nguyen
(74) *Attorney, Agent, or Firm*—Taylor & Aust P.C.

(57) ABSTRACT

A communication system includes a wiring closet having a data hub and a telephone switching device. Each of a plurality of workstations includes a telephone and/or a computer. A single cable assembly interconnects the wiring closet and the workstations. The cable assembly includes a plurality of connector assemblies, with each connector assembly being associated with a respective workstation. Each connector assembly has at least one breakout connector connected to a telephone or a computer of the respective workstation. Each of a plurality of cables has a plurality of electrical conductors. A first of the cables interconnects the wiring closet and a first of the connector assemblies. Other cables connect the first connector assembly and other connector assemblies in series.

11 Claims, 4 Drawing Sheets

DIRECT TO CLOSET WIRING SYSTEM

CROSS REFERENCE TO RELATED APPLICATIONS

This is a continuation-in-part of U.S. patent application Ser. No. 09/028,135, entitled "Communication System and Communication Cable Connector Assembly", filed Feb. 23, 1998.

BACKGROUND OF THE INVENTION

1. Field of the Invention

The present invention relates to communication cable systems, and, more particularly, communication cable systems for interconnecting a wiring closet with local area networks and/or telephones.

2. Description of the Related Art

An office environment is often divided into a plurality of workstations, each of which is located at a desk of an individual worker. Each workstation can include a telephone and a personal computer, or some other type of computer equipment. Each telephone must be hard wired to a telephone switching box, also known as a "patch panel". Similarly, each workstation's. computer equipment is often wired to a data hub, possibly for inclusion in a local area network (LAN). The telephone switching box and the data hub are often placed together in a small room, referred to as a "wiring closet", which is on the same floor of the same building as the workstations, as required by Category 5.

It is known to wire each of the workstations in parallel to the wiring closet. In a process called "field wiring", the voice and data lines of each workstation are meticulously matched to the correct connectors on each of the telephone switching box and the data hub in the wiring closet. A problem with field wiring is that it is time consuming, costly and requires skilled personnel, since the wiring of each workstation must be separately connected to specific connectors in the wiring closet. Because of the skill required, low quality and installation errors are also problems associated with field wiring.

It is also known to use an intermediate box called a "multi-user telecommunication outlet assembly" (MTOA) to interconnect the wiring closet and each of the workstations. In this case too, the workstations are wired in parallel, but to the MTOA rather than to the wiring closet. The MTOA and the wiring closet are interconnected by a plurality of parallel wires. These parallel wires can be premanufactured, but still do not directly plug into the telephone switching box or into the data hub. Thus, the MTOA must be field installed to the wiring closet by a premises wiring company.

The configuration of workstations in a modern open office is designed to be highly variable. When an office with point to point field wired communications is moved, it is first necessary to pull out and probably scrap the communication wiring. When the open office is reassembled, it is necessary for skilled cabling personnel to do a complete rewiring, usually going all the way back to the communications closet. In many instances, the open office furniture is not present when the wiring is being performed. Thus, multiple call backs of the wiring personnel are required.

SUMMARY OF THE INVENTION

What is needed in the art is a communications cabling system which interconnects a wiring closet with a plurality of workstations without the need for field wiring in order to install the communications cabling system.

The present invention provides a communications cabling system which starts from the wiring closet and requires neither MTOA boxes nor field wiring.

The invention comprises, in one form thereof, a communication system including a wiring closet having a data hub and a telephone switching device. Each of a plurality of workstations includes a telephone and/or a computer. A single cable assembly interconnects the wiring closet and the workstations. The cable assembly includes a plurality of connector assemblies, with each connector assembly being associated with a respective workstation. Each connector assembly has at least one breakout connector connected to a telephone and/or a computer of the respective workstation. Each of a plurality of cables has a plurality of electrical conductors. A first of the cables interconnects the wiring closet and a first of the connector assemblies. Other cables connect the first connector assembly and other connector assemblies in series.

An advantage of the present invention is that neither MTOA boxes nor field wiring is necessary, and the system may be installed by unskilled personnel.

Another advantage is that reconfigurations of the office layout are easily accommodated.

Yet another advantage is that the total number of the communications cables is much reduced, since workstations are connected in series rather than in parallel.

A further advantage is that the modularity of the connector assemblies allows the workstations to be easily reconnected to a different connector assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplification is not to be construed as limiting the scope of the invention in any manner.

DETAILED DESCRIPTION OF THE INVENTION

Figure 1:
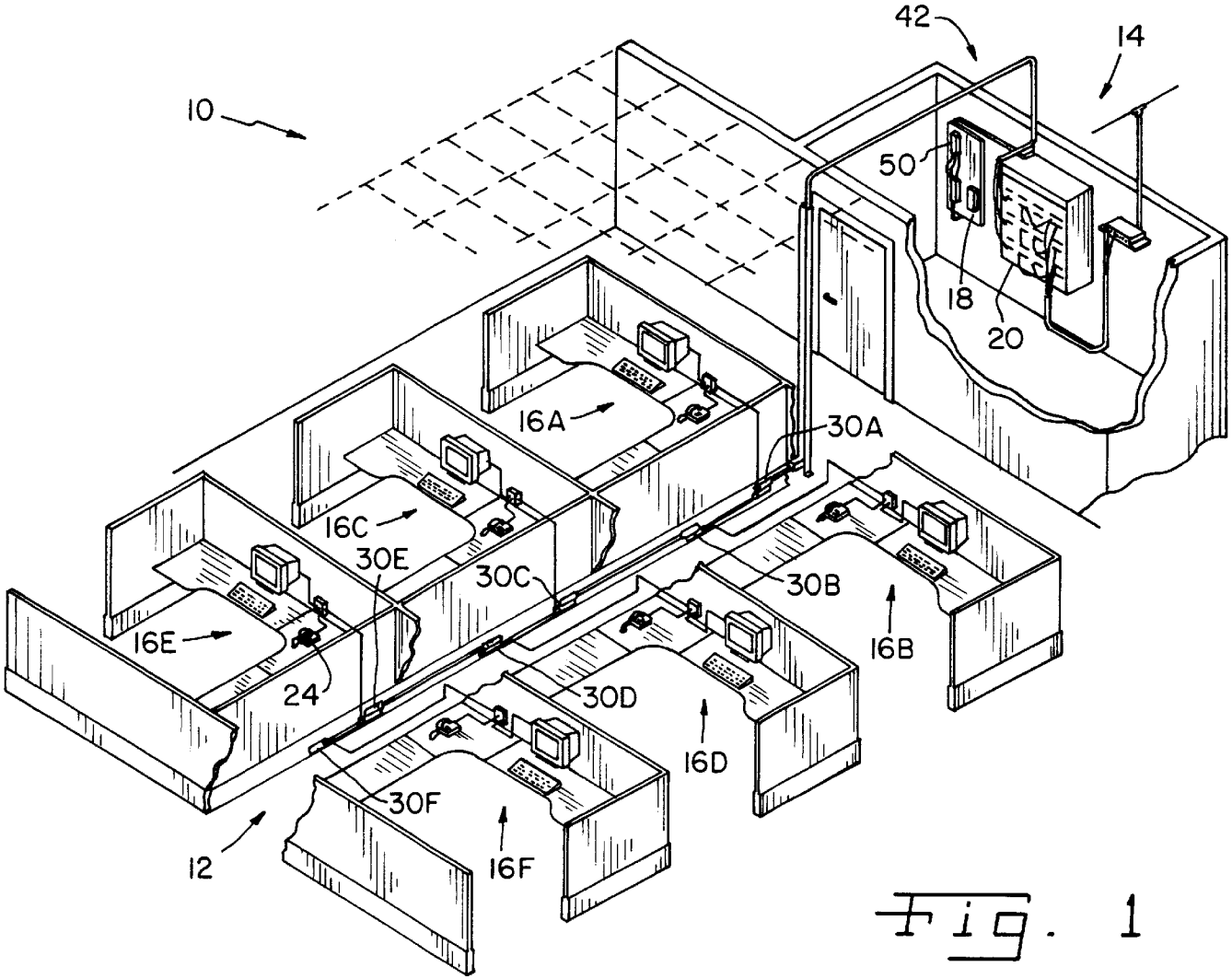
FIG. 1 is a perspective view of the direct to closet wiring system of the present invention.
Figure 3:
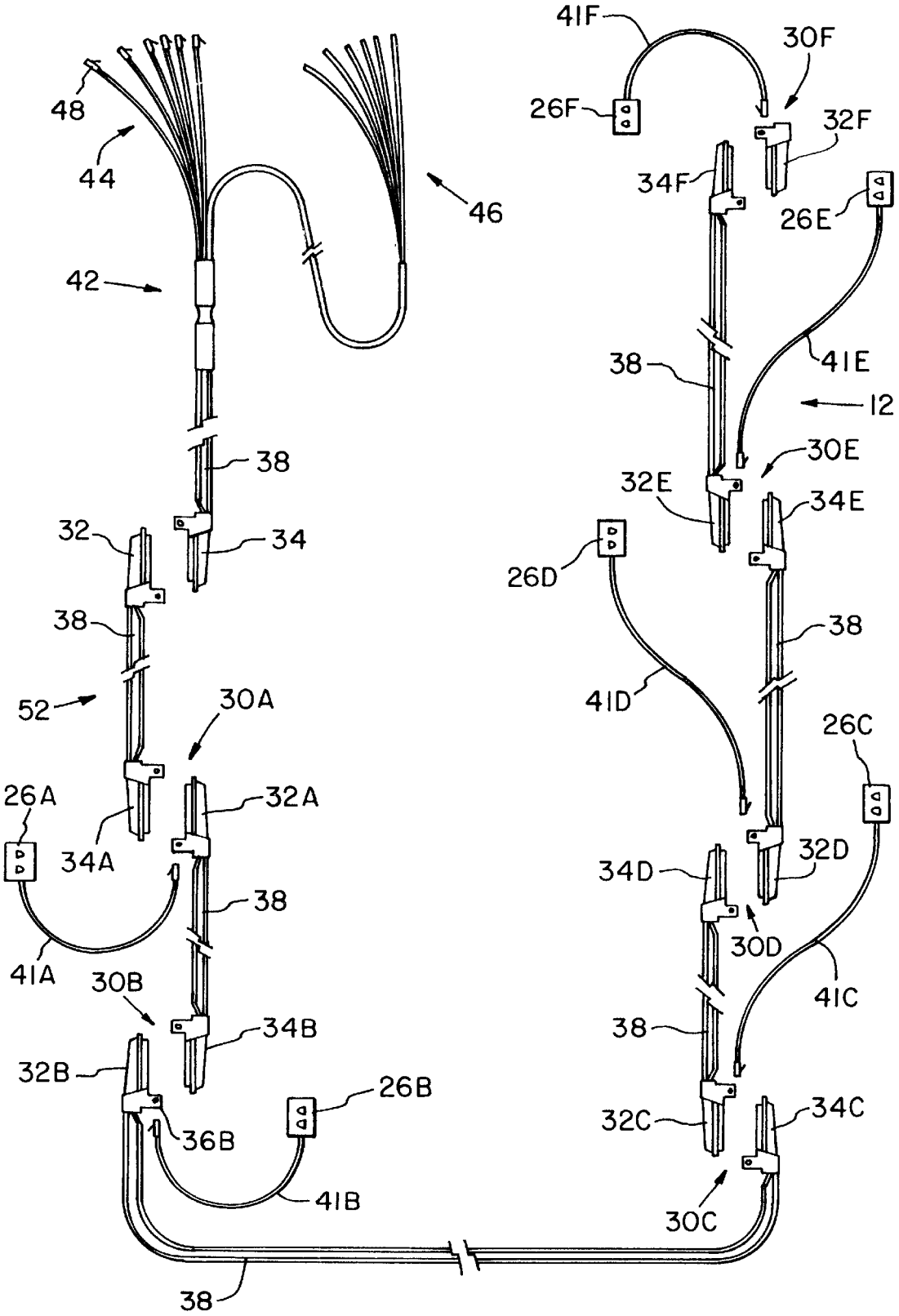
FIG. 3 illustrates one embodiment of a layout of the communication wiring system of FIGS. 1 and 2 including breakouts for six workstations.

Referring now to the drawings, and more particularly to FIG. 1, there is shown an embodiment of a communication system 10 of the present invention, including an embodiment of a communication wiring system 12 of the present invention (FIG. 3). Communication system 10 includes a wiring closet 14 and a plurality of workstations 16, with wiring closet 14 being connected to workstations 16 by wiring system 12.

Wiring closet 14 includes a telephone switching box 18 carrying voice signals, and a data hub 20 carrying data signals. It is also possible for box 18 and hub 20 to be disposed: in separate rooms, buried underground, or placed outside of the building.

Figure 2:
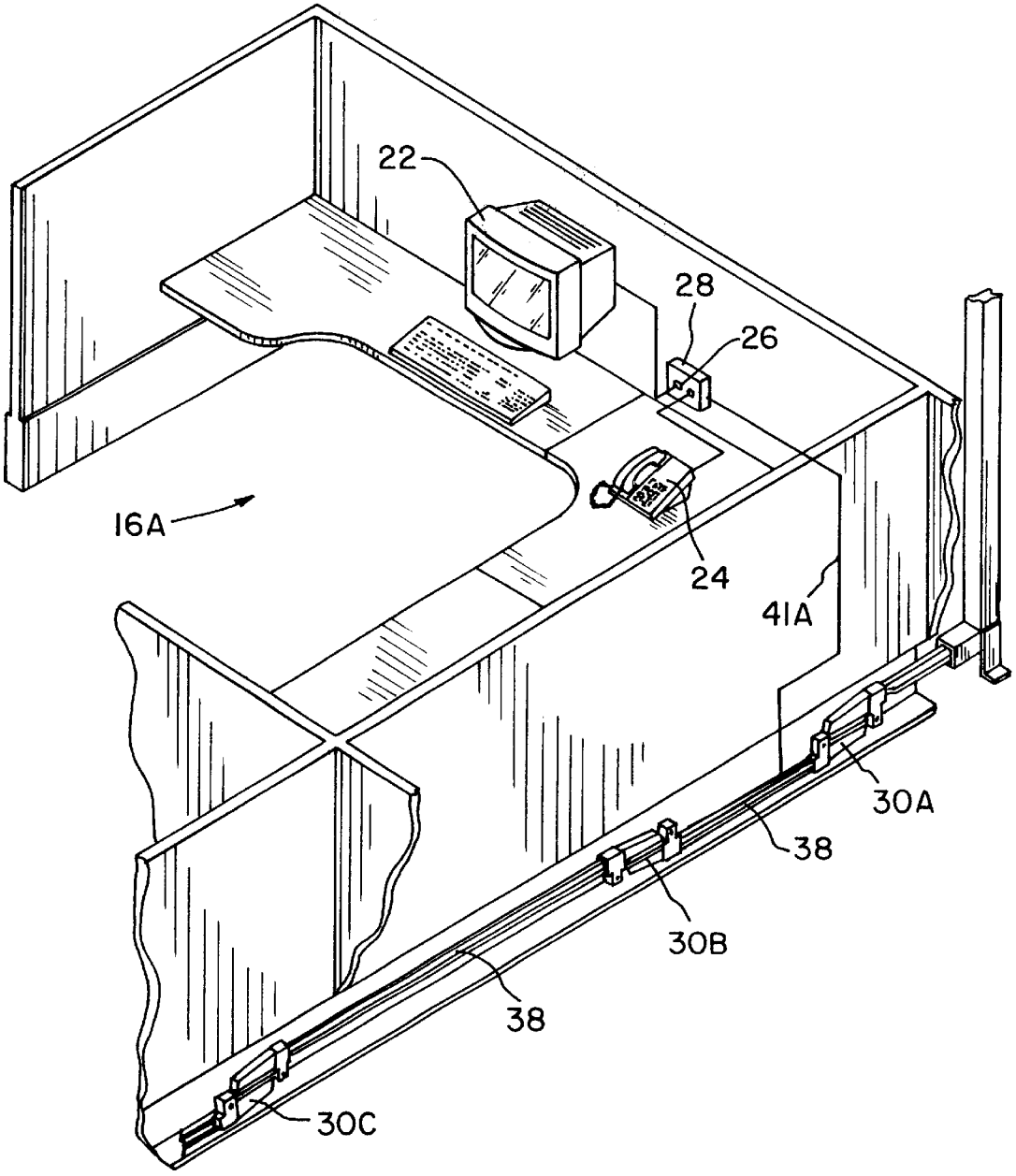
FIG. 2 is an enlarged view of a workstation of FIG. 1 and the associated connector assembly.

Each workstation 16, best seen in FIG. 2, includes a computer terminal 22 and a telephone 24, each of which is wired to a face plate 26 of a communications receptacle 28. Through wiring system 12, each computer terminal 22 is connected to data hub 20, and each telephone 24 is connected to telephone switching box 18. It is possible for a workstation 16 to include only a computer terminal 22, or only a telephone 24.

Figure 4:
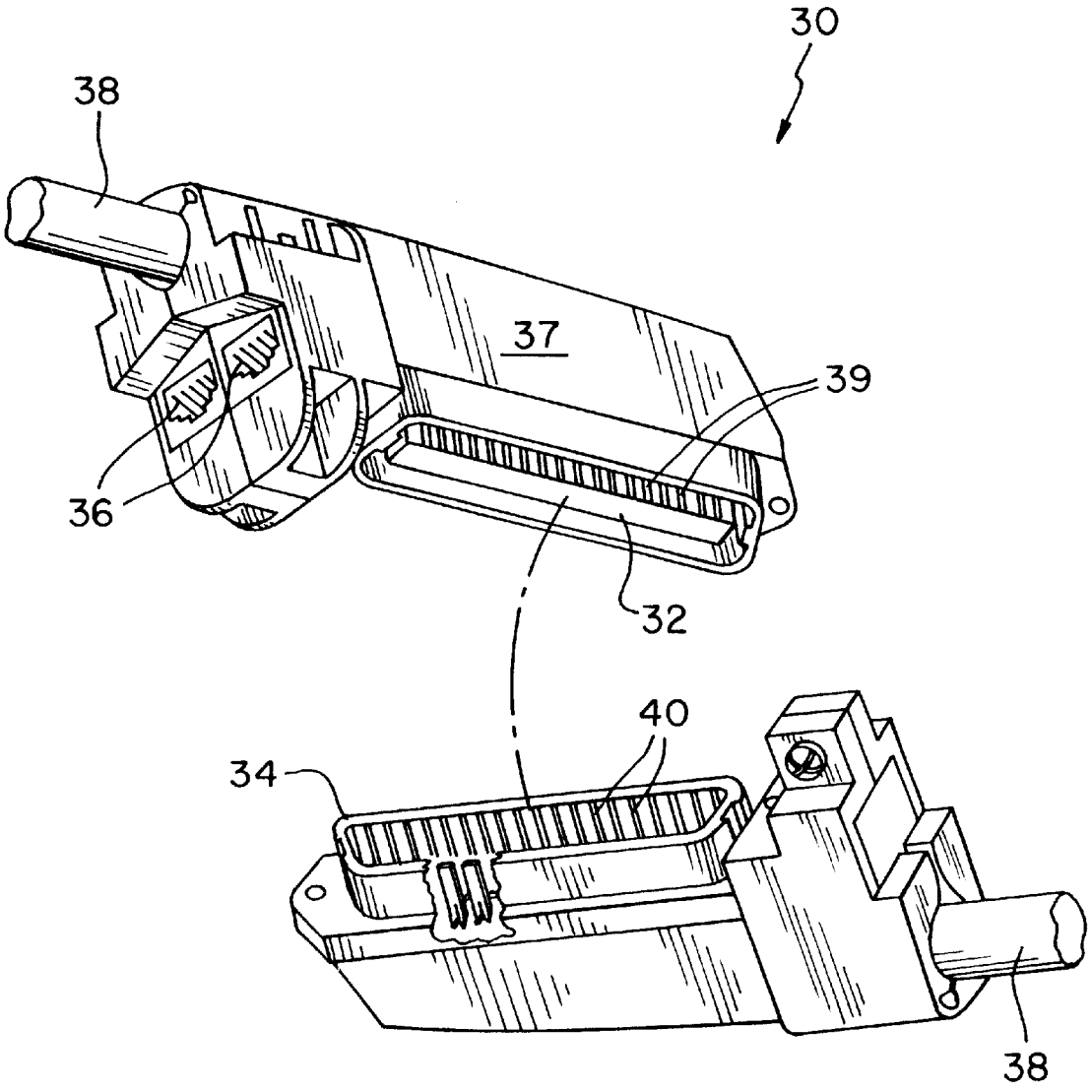
FIG. 4 is a perspective view of a communication connector assembly of the present invention including a male and female connector in a disassembled state.

FIG. 3 is a simplified illustration of one embodiment of the communication wiring system 12 of the present invention including six communication cable connector assemblies 30A–30F associated with workstations 16A–16F, respectively. Connector assemblies 30 can be placed within modular office partitions associated with respective workstations 16. Each connector assembly 30 includes a male connector 32 (FIG. 4), a female connector 34 which mates with male connector 32, and two breakout connectors 36 in the form of RJ-45 connectors. Male connector 32 and breakout connectors 36 are each carried by a common housing 37 for purposes of compactness and neatness.

Electrical cables 38 each have a plurality of electrical conductors in the form of twisted wire pairs therein. Respective electrical cables 38 interconnect a male connector 32 of one connector assembly 30 with a female connector 34 of another connector assembly. Thus, cables 38 interconnect connector assemblies 30 in series.

Cables 38 interconnect pins 39 of male connectors 32 with pins 40 of female connectors 34 in a stepped wiring arrangement. Due to this stepped wiring arrangement, breakout connectors 36 are always wired for connection to the next workstation 16 in the series. The interconnection between each male connector 32 and a following female connector 34 is a modified, stepped arrangement. That is, the interconnection between pins 39 of a male connector 32 with pins 40 of a following female connector 34 is such that the same pins 39 are used on each male connector 32 for connection with a corresponding breakout connector 36. The wires of cables 38 interconnect pins 39 of a male connector 32 with pins 40 of a following female connector 34 in a modified, stepped wiring arrangement which is consistent across communication wiring system 12 such that the same pins 39 of male connectors 32 are used in association with each breakout connector 36.

The length of each electrical cable 38 may vary, of course, depending upon the particular application.. Male connector 32F is slightly different from the remaining second connectors 32A–32E, in that male connector 32F is for use with the last breakout location and therefore is not attached with twisted wire pairs in an electrical cable 38. A respective patch cable 41 interconnects each connector assembly 30 with an associated workstation receptacle 28.

A starter cable assembly 42-includes a female connector 34 connected by a cable 38 to six data twisted wire pairs 44 corresponding to respective computer terminals 22; and to six voice twisted wire pairs 46 corresponding to respective telephones 24. RJ-45 connectors 48 are used to interconnect data twisted wire pairs 44 to data hub 20. Voice twisted wire pairs 46 are shown as not including RJ-45 connectors so that voice twisted wire pairs 46 can be connected to telephone switching box 18 via well known punch down connectors 50. In such punch down connectors 50, metal blades cut through the PVC insulation of voice twisted wire pairs 46 in order to make electrical contact. Alternatively, voice twisted wire pairs 46 can also be supplied with RJ-45 connectors for interconnection with telephone switching box 18. An optional extender cable assembly 52, including a cable 38 interconnecting a male connector 32 and a female connector 34, can be provided with a specific length so as to match the distance between starter cable assembly 42 and connector assembly 30A.

It can be readily appreciated that the modularity of communication wiring system 12, and of connector assemblies 30 in particular, allows one workstation 16 to be easily switched with another workstation 16. For example, workstations 16 may be physically moved and plugged into another receptacle 28, or the patch cable 41 associated with a certain workstation 16 may be unplugged from breakout connectors 36 of a connector assembly 30 and be plugged into another connector assembly 30.

Although the embodiment of communication system 10 shown in FIGS. 1–4 includes a specified number of workstations 16 with a predetermined number of breakout connectors 36, it is also to be appreciated that the number of workstations 16 and the number of breakout connectors 36 at each workstation 16 may vary for the particular application with which communication system 10 is used.

Where in this application the terms "telephone switching box", "telephone switching device" or the like are used, it is to be understood that such terms may encompass devices which include punch down connectors, a punch down block, and/or a terminal assembly.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A communication system, comprising:

a wiring closet including:

a data hub; and a telephone switching device;

a plurality of workstations, each of said workstations including at least one of a telephone and a computer; and a single cable assembly interconnecting said wiring closet and said plurality of workstations, said cable assembly including:

a plurality of connector assemblies including a first connector assembly, each of said connector assemblies being associated with a respective said workstation, each of said connector assemblies having at least one breakout connector connected to one of a telephone of said respective said workstation and a computer of said respective said workstation ; and a plurality of cables including a first cable, each of said cables having a plurality of electrical conductors, said first cable interconnecting said wiring closet and said first connector assembly, other said cables connecting said first connector assembly and other said connector assemblies in series.

2. The communication system of claim 1, wherein said each of said cables includes at least one of a plurality of telephone conductors and a plurality of data conductors.

3. The communication system of claim 2, further comprising at least one RJ-45 connector interconnecting said data hub and said data conductors of said first cable.

4. The communication system of claim 2, further comprising at least one punch down connector interconnecting said telephone switching device and said telephone conductors of said first cable.

5. The communication system of claim 1, wherein each said at least one breakout connector comprises an RJ-45 connector.

6. The communication system of claim 1, wherein said workstations are interchangeable such that any said workstation can be associated with any said connector assembly.

7. The communication system of claim 1, wherein said connector assemblies are interchangeable such that any said workstation can be associated with any said connector assembly.

8. The communication system of claim 1, wherein each of said connector assemblies includes a male connector and a female connector mated to said male connector.

9. The communication system of claim 1, wherein said cable assembly includes at least one patch cable, each said at least one patch cable interconnecting a respective connector assembly and said associated workstation.

10. A communication system, comprising:

a data hub;

a telephone switching device;

a plurality of workstations, each of said workstations including at least one of a telephone and a computer; and a single cable assembly, including:

a plurality of connectors including a first connector, each of said connectors being associated with a respective one of said workstations, each said connector having at least one breakout connector connected to one of a telephone of said respective one of said workstations and a computer of said respective one of said workstations; and a plurality of cables including a first cable, each of said cables having a plurality of telephone conductors and a plurality of data conductors, said telephone conductors of said first cable interconnecting said telephone switching device and said first connector, said data conductors of said first cable interconnecting said data hub and said first connector, other said cables connecting said first connector and other said connectors in series.

11. A communication system, comprising:

at least one of a data hub and a telephone switching device;

a plurality of workstations including a first workstation, each of said workstations including at least one of a telephone and a computer; and a plurality of cables including a first cable interconnecting said at least one of a data hub and a telephone switching device and said first workstation other said cables connecting said first workstation and other said workstations in series.

* * * * *